US008893891B2

(12) United States Patent
Apps

(10) Patent No.: US 8,893,891 B2
(45) Date of Patent: Nov. 25, 2014

(54) STACKABLE LOW DEPTH TRAY

(75) Inventor: William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 1183 days.

(21) Appl. No.: 12/059,857

(22) Filed: Mar. 31, 2008

(65) Prior Publication Data

US 2009/0242568 A1 Oct. 1, 2009

(51) Int. Cl.
*B65D 1/36* (2006.01)

(52) U.S. Cl.
USPC ..... 206/509; 206/511; 220/509; 220/516

(58) Field of Classification Search
CPC ..... B65D 2501/24222; B65D 2501/24108; B65D 2501/24019; B65D 2501/24585; B65D 21/0212; B65D 21/0215; B65D 1/246; B65D 1/243; B65D 21/0209
USPC ..... 206/509, 511; 220/509, 516
See application file for complete search history.

(56) References Cited

U.S. PATENT DOCUMENTS

| | | | |
|---|---|---|---|
| 820,445 | A | 5/1906 | Speer |
| D103,862 | S | 3/1937 | Randall et al. |
| 2,411,673 | A | 11/1946 | Vechey, Jr. |
| D147,981 | S | 11/1947 | Lehman |
| D152,907 | S | 3/1949 | Richards |
| 2,588,805 | A | 3/1950 | Cross |
| 2,512,855 | A | 6/1950 | Erickson |
| 2,530,481 | A | 11/1950 | Rawn, Jr. |
| 2,526,335 | A | 12/1950 | Diechert |
| 2,535,493 | A | 12/1950 | Gerber |
| 2,626,079 | A | 1/1953 | Keller |
| D172,664 | S | 7/1954 | Emery |
| 2,743,030 | A | 4/1956 | Read, Jr. |
| 2,840,256 | A | 6/1958 | Cobb, Jr. |
| 2,928,530 | A | 3/1960 | Sauey |
| 2,935,222 | A | 5/1960 | O'Connell |
| 2,970,715 | A | 2/1961 | Kappel et al. |
| D189,891 | S | 3/1961 | Schilling et al. |
| 2,974,819 | A | 3/1961 | Melville |
| 2,979,222 | A | 4/1961 | Levine |
| 3,009,579 | A | 11/1961 | Ettlinger, Jr. |

(Continued)

FOREIGN PATENT DOCUMENTS

| | | |
|---|---|---|
| BE | 680197 | 10/1966 |
| BE | 693216 | 1/1967 |

(Continued)

OTHER PUBLICATIONS

European Search Report for EP Application No. 09012596.4, Jan. 25, 2010.

(Continued)

*Primary Examiner* — Stephen Castellano
(74) *Attorney, Agent, or Firm* — Carlson, Gaskey & Olds

(57) ABSTRACT

A tray for storing and transporting bottles includes a plurality of spaced apart base walls each for supporting a bottle thereon. A pair of opposed side walls and a plurality of interior columns are connected by a plurality of dividers. The dividers also connect the columns and the side walls to the base wall. Each divider includes a lower end having spaced apart pocket walls each connected to a different one of the base walls.

24 Claims, 15 Drawing Sheets

(56) References Cited

U.S. PATENT DOCUMENTS 3,055,531 A 9/1962 De Chelbor
3,055,542 A 9/1962 Russo
3,092,284 A 6/1963 Stout
D195,702 S 7/1963 Russo
3,151,762 A 10/1964 Vidal
3,184,148 A 5/1965 Poupitch
D201,257 S 6/1965 Vidal
3,247,996 A 4/1966 Garcia
3,283,947 A 11/1966 Cornelius
3,297,190 A 1/1967 Cloyd
D208,111 S 7/1967 Vidal
3,332,574 A 7/1967 Earp
3,333,727 A 8/1967 Belcher et al.
3,333,729 A 8/1967 Rabb
3,334,767 A 8/1967 Cornelius et al.
3,349,943 A 10/1967 Box
D209,864 S 1/1968 Versteeg et al.
3,376,998 A 4/1968 Cornelius
3,384,261 A 5/1968 Austin
3,390,801 A 7/1968 Adomat
3,391,814 A 7/1968 Box
3,391,815 A 7/1968 Box
3,392,869 A 7/1968 Needt
3,416,694 A 12/1968 Bebb
3,428,207 A 2/1969 Scholler
3,517,852 A 6/1970 Schoeller
3,628,684 A 12/1971 Sere
3,638,824 A 2/1972 Sekiguchi et al.
3,701,449 A 10/1972 Schoeller
3,759,416 A 9/1973 Constantine
D229,674 S 12/1973 Quigg
3,812,996 A 5/1974 Bunnell
3,865,239 A 2/1975 Herolzer et al.
3,949,876 A 4/1976 Bridges et al.
3,991,879 A 11/1976 Hirota
3,998,237 A 12/1976 Kressin et al.
3,998,328 A 12/1976 Box
4,027,796 A 6/1977 Martin
4,037,722 A 7/1977 Bremer
4,040,517 A 8/1977 Torokvei
4,071,162 A 1/1978 Steinlein et al.
4,095,720 A 6/1978 Delbrouck et al.
4,101,049 A 7/1978 Wallace et al.
4,161,259 A 7/1979 Palafox
4,162,738 A 7/1979 Wright
4,202,448 A 5/1980 Jaeger et al.
4,204,596 A 5/1980 Davis
4,308,966 A 1/1982 Ettema et al.
4,319,685 A 3/1982 David
4,344,530 A 8/1982 deLarosiere
D266,709 S 10/1982 Box
D268,791 S * 4/1983 Wood ..... D3/309
4,410,099 A 10/1983 deLarosiere
4,416,373 A 11/1983 deLarosiere
D275,142 S 8/1984 Torokvei
4,538,742 A 9/1985 Prodel
4,548,320 A 10/1985 Box
D283,103 S 3/1986 Cushing et al.
D284,841 S 7/1986 Rowland et al.
D289,938 S 5/1987 Warwick
D291,178 S 8/1987 Toms
4,700,836 A 10/1987 Hammett
4,700,837 A 10/1987 Hammett
D295,107 S 4/1988 Frost
4,773,554 A 9/1988 Warwick
4,789,063 A 12/1988 Hammett
4,848,580 A 7/1989 Wise
D304,123 S 10/1989 Warwick
4,899,874 A 2/1990 Apps et al.
4,911,303 A 3/1990 Andersson
4,928,841 A 5/1990 Arthurs
4,932,532 A 6/1990 Apps et al.
4,978,000 A 12/1990 Mohr
4,978,002 A 12/1990 Apps et al.
D313,493 S 1/1991 Apps et al.
D317,670 S 6/1991 Apps
D318,552 S 7/1991 Apps
5,031,774 A 7/1991 Morris et al.
D319,129 S 8/1991 Apps et al.
D320,298 S 9/1991 Apps et al.
5,060,819 A 10/1991 Apps
5,071,026 A 12/1991 Apps
5,096,085 A 3/1992 Eek et al.
D325,279 S 4/1992 Apps
5,105,948 A 4/1992 Morris et al.
D326,749 S 6/1992 Apps et al.
D327,357 S 6/1992 Rehrig
D327,972 S 7/1992 Apps et al.
D329,931 S 9/1992 Apps
D329,932 S 9/1992 Apps
5,184,748 A * 2/1993 Apps ..... 220/519
5,267,649 A 12/1993 Apps et al.
5,305,884 A 4/1994 Apps et al.
5,316,172 A 5/1994 Apps et al.
5,320,245 A 6/1994 Apps et al.
5,335,814 A 8/1994 Hepp
D350,438 S 9/1994 Apps et al.
5,351,814 A 10/1994 Apps
5,377,862 A 1/1995 Oakes et al.
5,405,042 A 4/1995 Apps et al.
5,421,477 A 6/1995 Hammett
D360,758 S 8/1995 Umiker
D361,431 S 8/1995 Koefelda
5,465,843 A 11/1995 Koefelda
5,487,487 A 1/1996 Hammett
5,495,945 A 3/1996 Apps et al.
5,501,352 A 3/1996 Apps
5,529,176 A 6/1996 Apps et al.
5,575,390 A 11/1996 Apps et al.
D378,249 S 3/1997 Apps et al.
D379,121 S 5/1997 Apps et al.
D379,717 S 6/1997 Apps et al.
D380,613 S 7/1997 Apps et al.
D380,901 S 7/1997 Apps et al.
5,651,461 A 7/1997 Apps et al.
5,660,279 A 8/1997 Apps et al.
5,704,482 A 1/1998 Apps et al.
5,769,230 A 6/1998 Koefelda
D395,954 S 7/1998 Apps et al.
D399,060 S 10/1998 Apps et al.
D400,012 S 10/1998 Apps
5,823,376 A 10/1998 McGrath
D401,764 S 12/1998 Apps et al.
5,842,572 A 12/1998 Apps et al.
D404,204 S 1/1999 Apps
5,855,277 A 1/1999 Apps et al.
D410,778 S 6/1999 Apps et al.
D412,399 S 8/1999 Apps et al.
5,964,343 A 10/1999 Steiner
5,971,204 A 10/1999 Apps
5,979,654 A 11/1999 Apps
D417,784 S 12/1999 Umiker
6,006,912 A 12/1999 McGrath
D420,220 S 2/2000 Apps et al.
6,047,844 A 4/2000 McGrath
6,073,793 A 6/2000 Apps et al.
6,079,554 A 6/2000 Hammett et al.
6,112,938 A 9/2000 Apps
6,131,730 A 10/2000 Hsu
6,189,734 B1 2/2001 Apps et al.
6,237,758 B1 5/2001 Hsu
D446,015 S 8/2001 Apps
D461,957 S 8/2002 Hammett
D462,522 S 9/2002 Apps et al.
6,454,120 B1 9/2002 Hammett
6,457,599 B1 10/2002 Apps et al.
D465,417 S 11/2002 Apps
D466,018 S 11/2002 Apps
D468,634 S 1/2003 Hammett
D483,946 S 12/2003 Koefelda
D485,756 S 1/2004 Apps
D487,634 S 3/2004 Apps et al.
D494,867 S 8/2004 Apps
6,851,563 B1 2/2005 Lipari

(56) References Cited

U.S. PATENT DOCUMENTS

| | | | |
|---|---|---|---|
| D505,014 | S | 5/2005 | Apps et al. |
| 6,892,885 | B2 | 5/2005 | Apps et al. |
| 6,899,247 | B1 | 5/2005 | Koefelda et al. |
| D507,880 | S | 8/2005 | Hassell et al. |
| 6,966,442 | B2 | 11/2005 | Hassell et al. |
| 7,017,746 | B2 | 3/2006 | Apps |
| 7,086,531 | B2 | 8/2006 | Apps et al. |
| 7,097,033 | B2 | 8/2006 | Koefelda et al. |
| 7,128,234 | B2 | 10/2006 | Apps et al. |
| 7,207,458 | B1 | 4/2007 | Koefelda et al. |
| 7,252,196 | B1 | 8/2007 | Koefelda et al. |
| 7,281,641 | B2 | 10/2007 | Apps |
| 7,311,217 | B2 | 12/2007 | Apps |
| 7,322,475 | B2 | 1/2008 | Hassell et al. |
| 7,322,486 | B2 | 1/2008 | Koefelda et al. |
| 7,549,539 | B2 | 6/2009 | Apps |
| 7,604,122 | B2 | 10/2009 | Apps et al. |
| 7,677,405 | B2 | 3/2010 | Apps et al. |
| 7,694,839 | B2 | 4/2010 | Koefelda et al. |
| D615,758 | S | 5/2010 | Lindstrom |
| 7,735,676 | B2 | 6/2010 | Ogburn |
| 7,743,939 | B2 | 6/2010 | Stahl |
| 7,950,521 | B2 | 5/2011 | Apps |
| 8,056,753 | B2 | 11/2011 | Koefelda et al. |
| 2002/0148837 | A1 | 10/2002 | Apps |
| 2002/0195452 | A1 | 12/2002 | Apps |

FOREIGN PATENT DOCUMENTS

| | | |
|---|---|---|
| CA | 965056 | 3/1975 |
| CA | 1109433 | 9/1981 |
| DE | 1207268 | 12/1965 |
| EP | 0099827 | 10/1986 |
| EP | 0210712 | 8/1990 |
| EP | 0 464 894 | 1/1992 |
| EP | 1008527 | 11/1999 |
| EP | 2 107 006 | 10/2009 |
| FR | 1285689 | 1/1962 |
| FR | 1350962 | 1/1963 |
| FR | 1350962 | 12/1963 |
| FR | 1351218 | 12/1963 |
| FR | 1518610 | 2/1968 |
| FR | 2302244 | 2/1975 |
| FR | 2302244 | 9/1976 |
| GB | 758817 | 10/1956 |
| GB | 943947 | 12/1963 |
| GB | 1032916 | 6/1966 |
| GB | 1115343 | 5/1968 |
| GB | 1120067 | 7/1968 |
| GB | 1152038 | 5/1969 |
| GB | 1312701 | 4/1973 |
| GB | 1319726 | 6/1973 |
| GB | 1330778 | 9/1973 |
| GB | 2 017 645 | 10/1979 |
| GB | 2079256 | 1/1982 |
| GB | 2135278 | 8/1984 |
| GB | 2158044 | 11/1985 |
| NL | 6505562 | 10/1966 |
| WO | 82/01536 | 5/1982 |
| WO | 96/40566 | 12/1996 |
| WO | 98/07636 | 2/1998 |
| WO | 00/41937 | 7/2000 |
| WO | 2006/026783 | 3/2006 |
| WO | 2009/043038 | 4/2009 |

OTHER PUBLICATIONS

European Search Report for EP Application No. 09012612.9, Jan. 8, 2010.

U.S. Appl. No. 12/573,409, filed Oct. 5, 2009, "Stackable Low Depth Tray".

U.S. Appl. No. 12/556,616, filed Sep. 10, 2009, "Stackable Low Depth Tray".

U.S. Appl. No. 12/573,414, filed Oct. 5, 2009, "Stackable Low Depth Tray".

U.S. Appl. No. 12/619,143, filed Nov. 16, 2009, "Low Depth Crate".

U.S. Appl. No. 61/167,776, filed Apr. 8, 2009, "Stackable Low Depth Tray".

U.S. Appl. No. 61/184,768, filed Jun. 5, 2009, "Stackable Low Depth Tray".

European Search Report for European Application No. 09156468.2, May 27, 2009.

Exhibit 1: Four photos of a prior art case of Rehrig Pacific Company, Model No. PLBC-8-2L-PET-QD (1984).

Exhibit 2: Two photos of a prior art case of Rehrig Pacific Company for 3 liter PET bottles (1990).

Exhibit 3: Two photos of a prior art case of D.W. Plastics (date unknown).

Exhibit 4: Two photos of a prior art case of International Container Systems, Inc. for 3 liter PET bottles (date unknown).

Photograph of PEPSI—Blue Crate, Top View.

Photograph of PEPSI—Blue Crate, Bottom View 1.

Photograph of PEPSI—Blue Crate, Bottom View 2.

Photograph of Norseman NPL 405 Crate, Top View.

Photograph of Norseman NPL 405 Crate, Bottom View.

Photograph of Coca Cola Crate, Top View.

Photograph of Coca Cola Crate, Bottom View.

Photograph of 2L Coca Cola "Tulip" Crate, Top View.

Photograph of 2L Coca Cola "Tulip" Crate, Bottom View 1.

Photograph of 2L Coca Cola "Tulip" Crate, Bottom View 2.

Photograph of 2L Coca Cola "Tulip" Crate, Bottom View 3.

Commercial embodiment of U.S. Patent No. 7,017,746, sold in 2002.

* cited by examiner

STACKABLE LOW DEPTH TRAY

BACKGROUND OF THE INVENTION

The present invention relates to a stackable low depth tray for storing and transporting beverages containers, such as bottles.

Plastic bottles are widely used as containers for soft drinks and other beverages. These bottles are often stored and transported in trays, particularly plastic trays. There are many known tray designs that are referred to as "low depth" trays in which the side and end walls are lower than the height of the stored bottles, and in which the bottles support the weight of additional trays and bottles stacked thereon.

It is desirable to reduce the nesting height of empty trays, to reduce the storage and transportation costs and space required. At the same time, it is desirable to have sufficient lateral support for the bottles to enhance the stability of stacks of loaded trays.

SUMMARY OF THE INVENTION

A tray according to one embodiment of the present invention significantly increases the height of support for the bottles without increasing the nesting height of stacks of empty trays.

One example tray includes a plurality of spaced apart base walls, a pair of opposed side walls and a plurality of interior columns between the side walls. The interior columns extend up higher than the side walls. A plurality of dividers connect the interior columns to one another and to the side walls. The dividers also connect the base walls to the interior columns and to the columns. Each divider has a lower end having spaced apart pocket walls each connected to a different one of the spaced apart base walls.

The pocket walls increase the support height of a bottle received therein but are still fully nestable within the side walls of a similar tray.

These and other features of the application can be best understood from the following specification and drawings, the following of which is a brief description.

DETAILED DESCRIPTION OF THE PREFERRED EMBODIMENT

Figure 1:
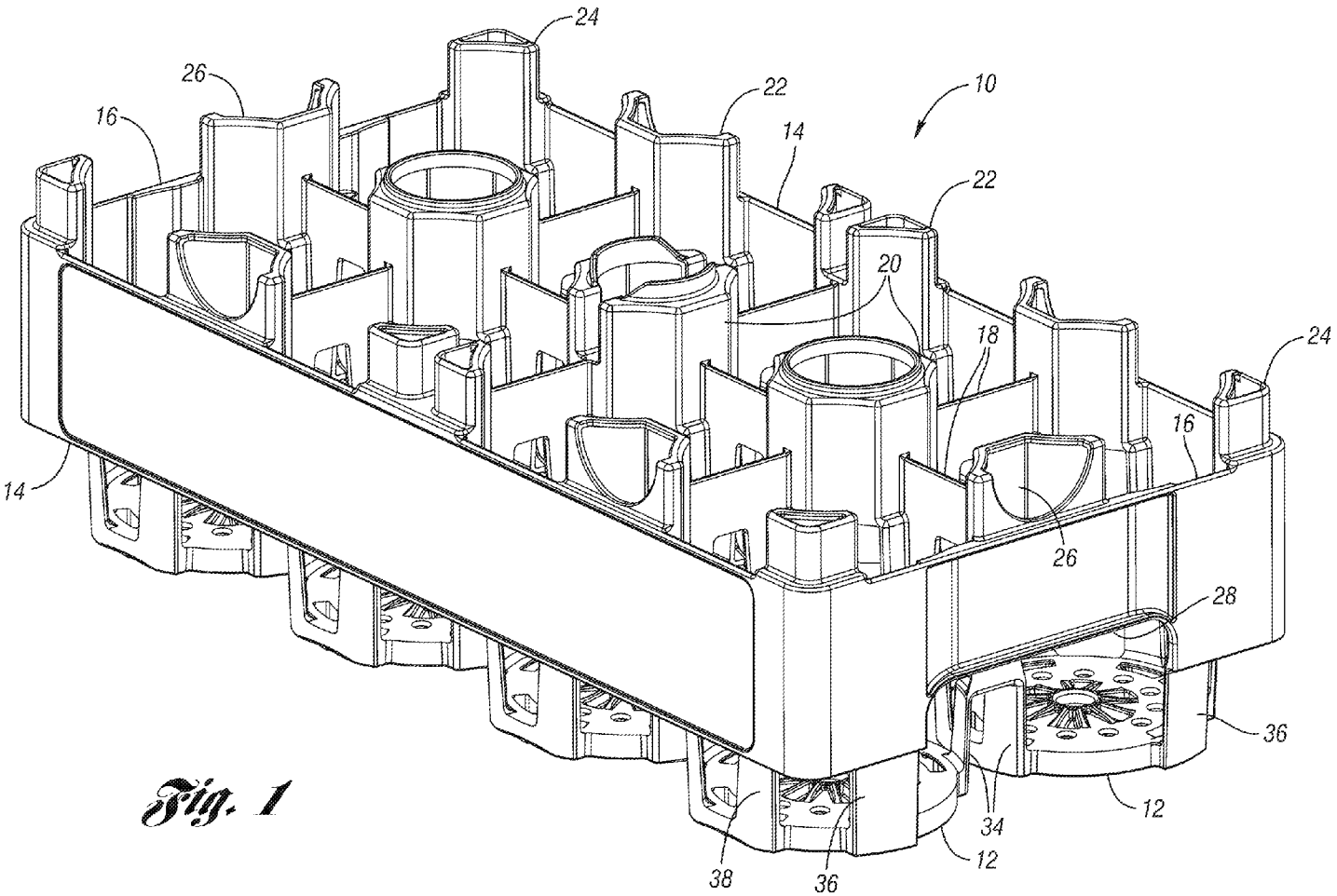
FIG. 1 is a perspective view of a tray according to one embodiment of the present invention.

A tray 10 according to one embodiment of the present invention is shown in FIG. 1. The tray 10 includes a plurality (in this example, eight) of spaced apart base walls 12. The tray 10 further includes a pair of opposed side walls 14 connected by a pair of opposed end walls 16. A plurality of dividers 18, together with the base walls 12, side walls 14 and end walls 16 define a plurality of bottle receiving pockets. A plurality of interior columns 20 extend upwardly between the side walls 14. A plurality of side columns 22 extend upwardly from the side walls 14. Corner columns 24 extend upwardly from the corners, while end columns 26 extend upwardly from the end walls 16.

The dividers 18 each have a lower end including two pair of spaced apart interior pocket walls 34, two of each pair connected to a different base wall 12. The end walls 16 are connected to the base walls 12 by end pocket walls 36, while the side walls 14 are connected to the base walls 12 by side pocket walls 38. The end pocket walls 36 and the side pocket walls 38 are spaced inwardly of the end walls 16 and side walls 14, respectively. The pocket walls 34, 36, 38 each have a concave interior surface and convexly curved exterior surface to define a generally cylindrical broken inner surface and a generally cylindrical broken outer surface around each base wall 12. The pocket walls 34, 36, 38 and base walls 12 define lower pocket portions.

Figure 2:
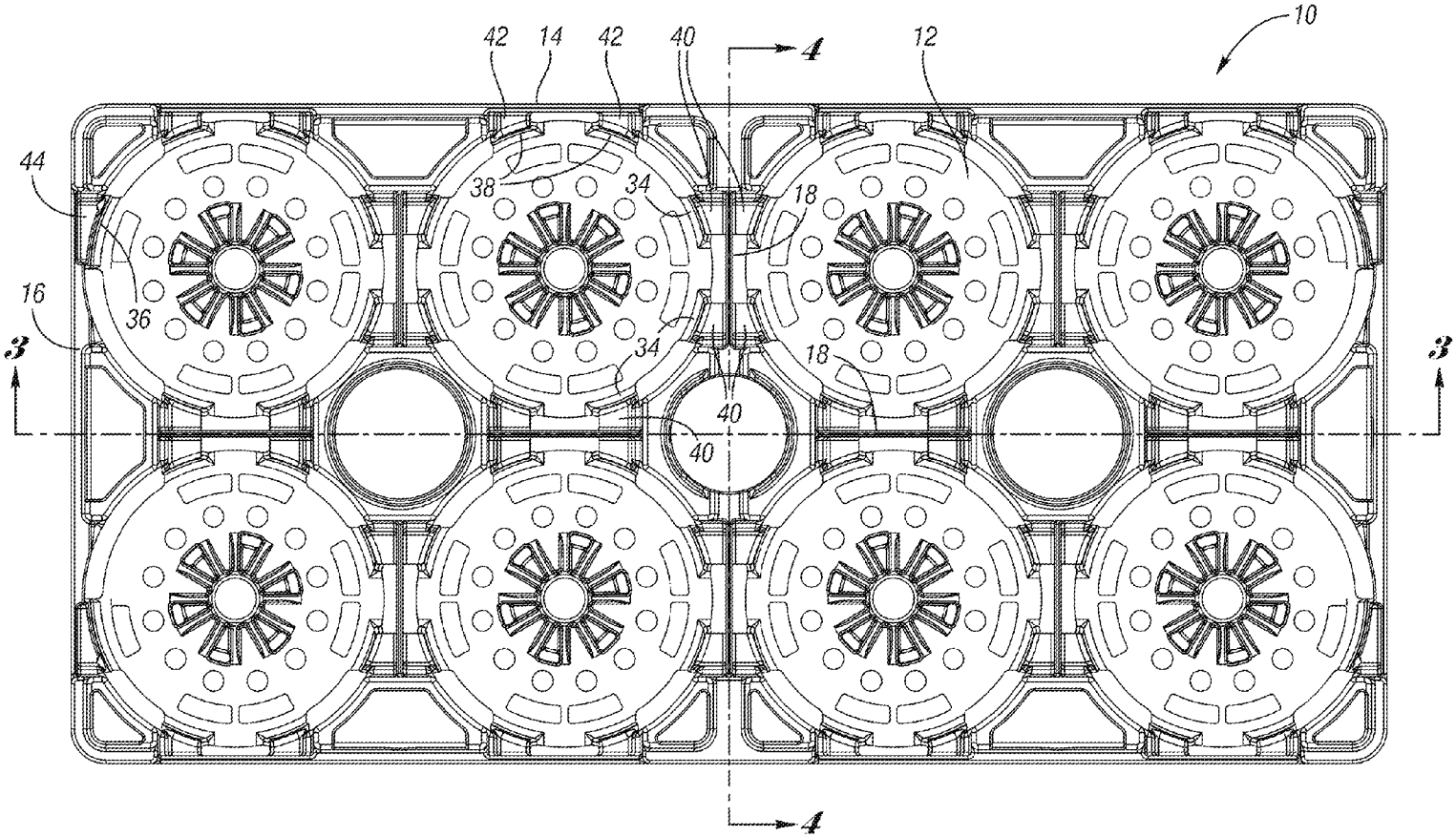
FIG. 2 is a top view of the tray of FIG. 1.
Figure 2A:
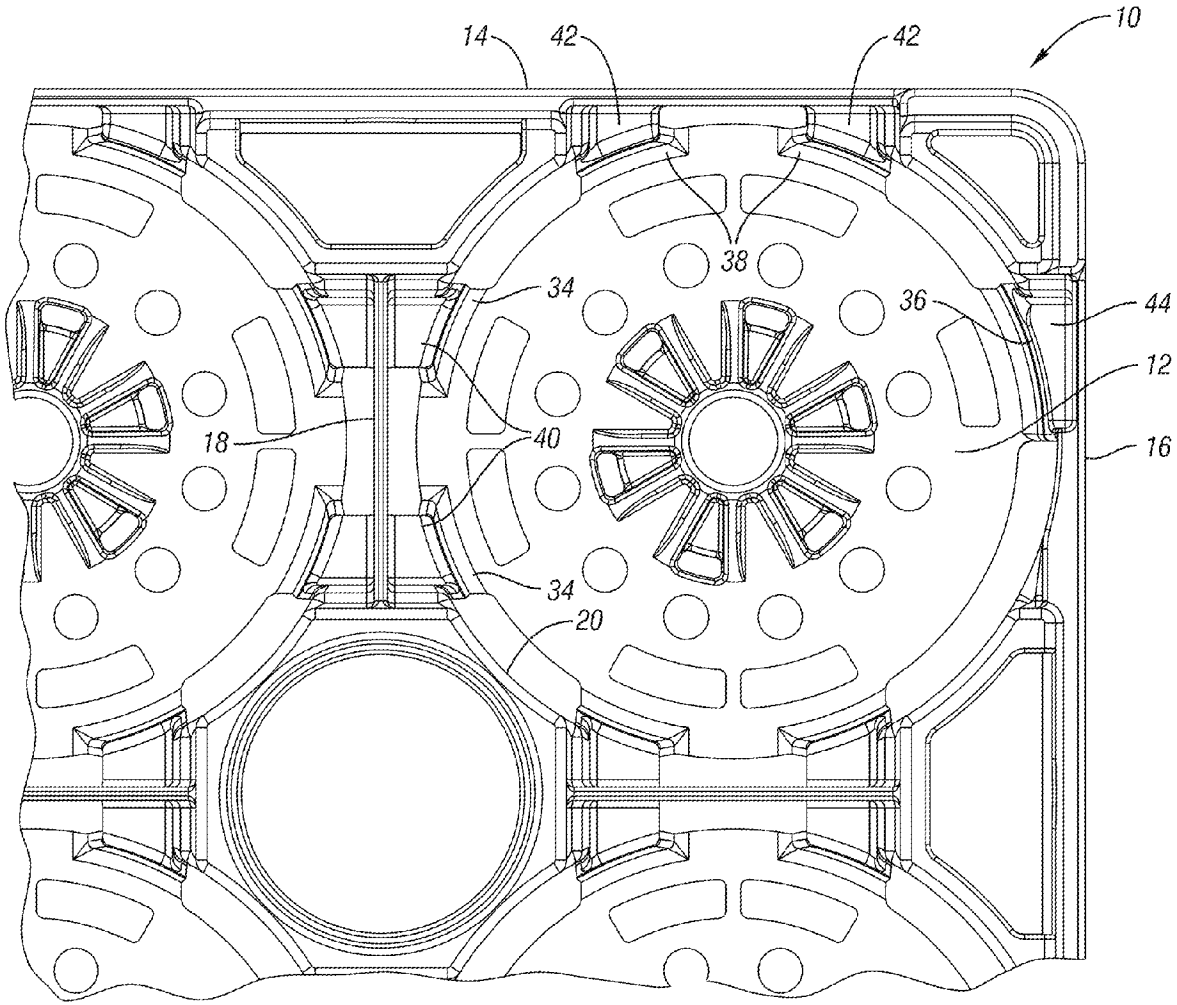
FIG. 2A is an enlarged view of one pocket of the tray of FIG. 2.

As shown in the top view of FIG. 2 and in the enlarged view of FIG. 2A, the dividers 18 each include a laterally diverging wall 40 (or horizontal wall 40) from which the interior pocket walls 34 depend downwardly to the base wall 12. Similarly, the side walls 14 include horizontal walls or ledges 42 protruding inwardly from which the side pocket walls 38 depend downwardly to the base wall 12. The end wall 16 also includes a horizontal wall or ledge 44 protruding inwardly from which the end pocket wall 36 depends downwardly to the base wall 12. The pocket walls 34, 36, 38 taper inwardly toward the base wall 12.

Figure 3:
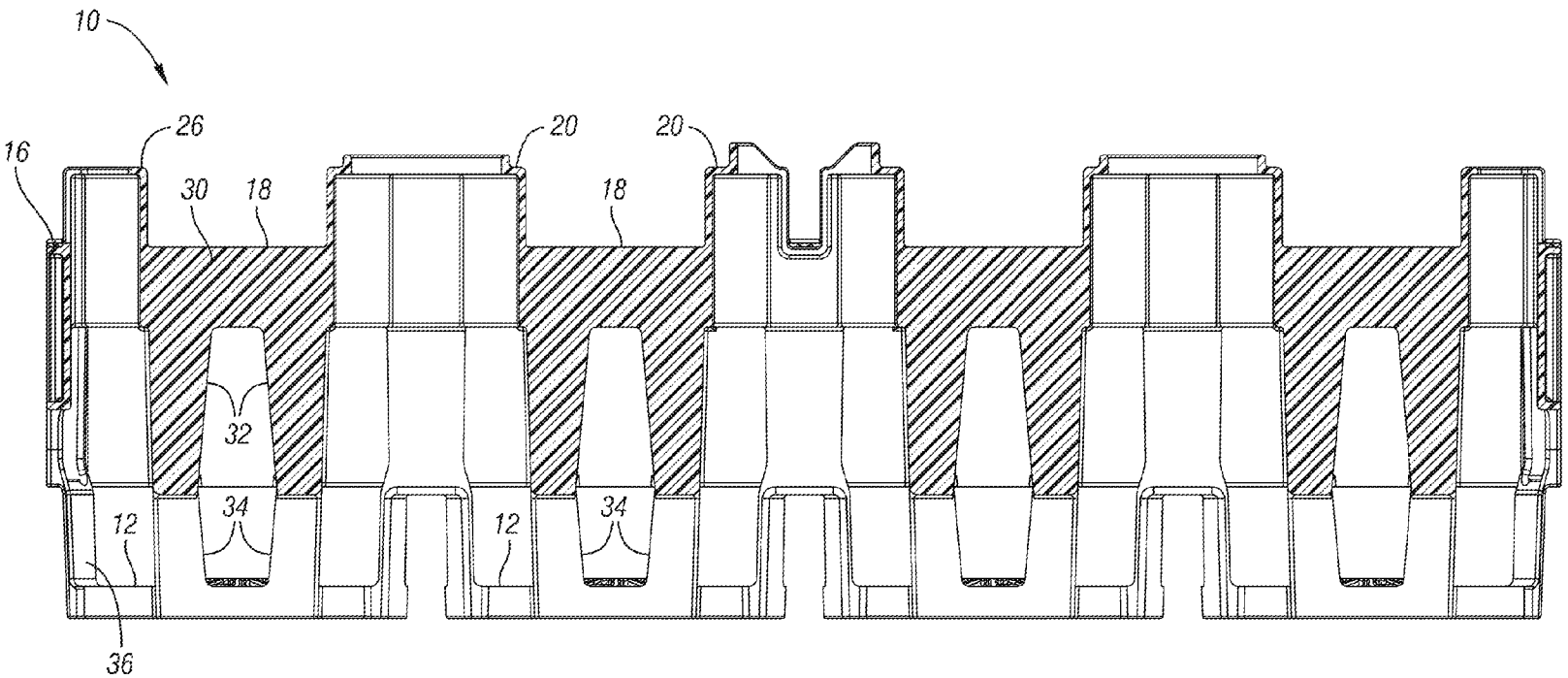
FIG. 3 is a section view taken along line 3-3 of FIG. 2.

FIG. 3 is a section view taken along line 3-3 of FIG. 2. As shown, the upper portion of each divider 18 includes a header 30 that extends directly between adjacent structures (e.g. columns 20, 26 and/or columns 22 (FIG. 4)) and spaced apart leg portions 32 that are coplanar with the header portion 30. The opening formed between the leg portions 32 reduces the overall weight of the tray 10 without decreasing the rigidity, because the header portion 30 extends solidly where it is most needed. The lower end of each divider 18 then includes two pairs of spaced apart interior pocket walls 34 extending downward to the base walls 12.

Figure 4:
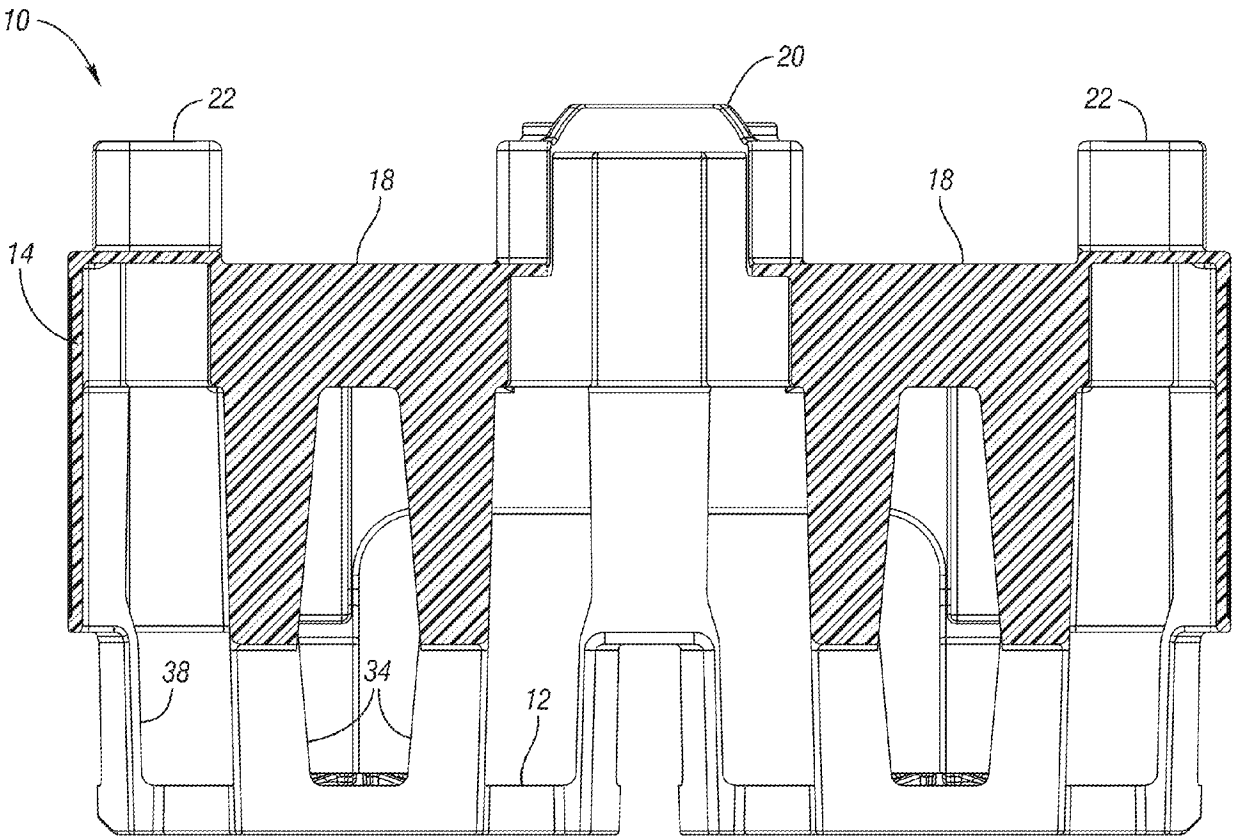
FIG. 4 is a section view taken along line 4-4 of FIG. 2.

Referring to FIG. 4, the dividers 18 extending between side columns 22 and interior columns 20 are similar to those of FIG. 3 and also include two pairs of spaced apart interior pocket walls 34, each connected to each base wall 12. The side walls 14 are connected to the base wall 12 by side pocket walls 38.

Figure 5:
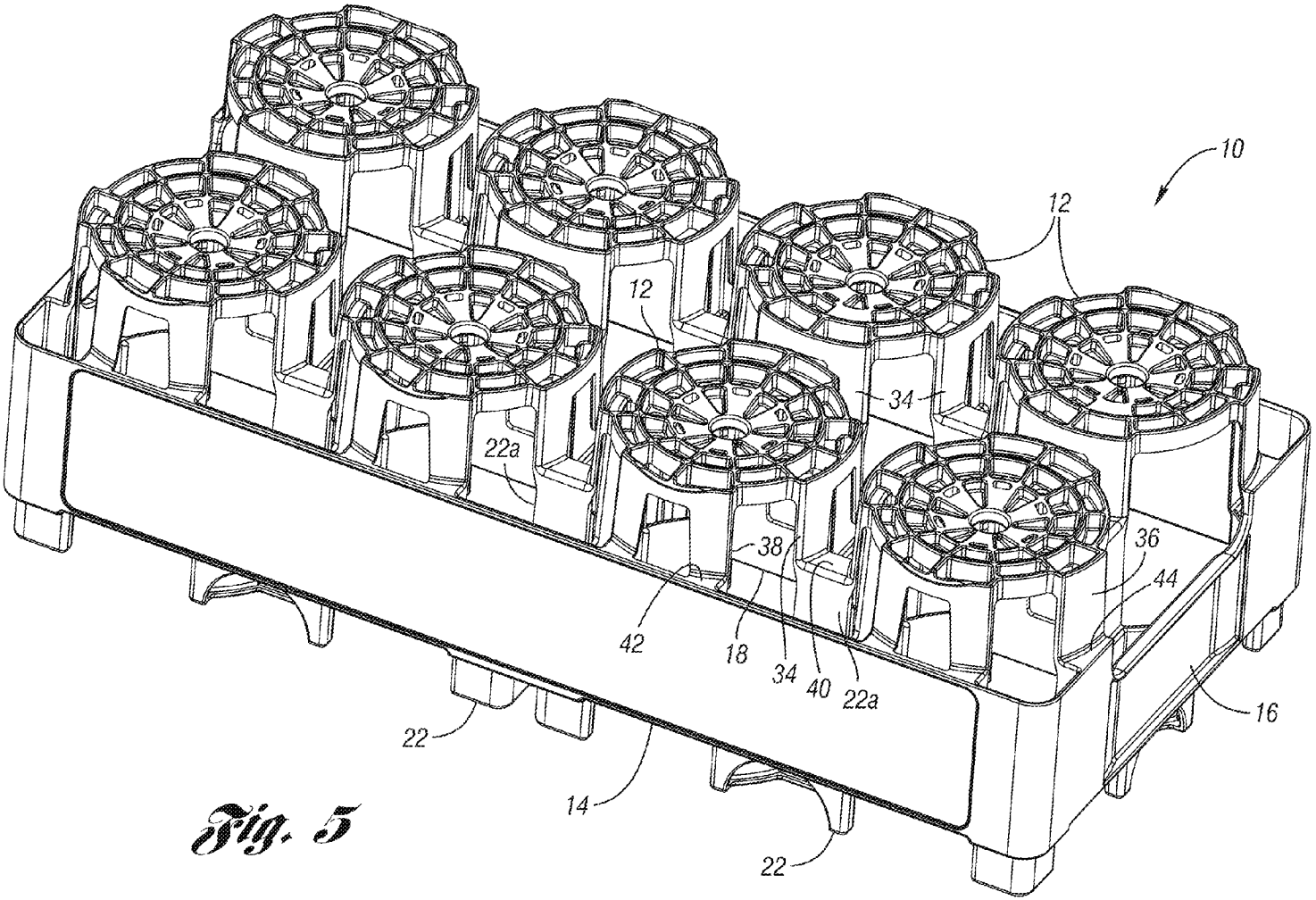
FIG. 5 is a bottom perspective view of the tray.

FIG. 5 is a bottom perspective view of the tray 10 of FIG. 1. The interior pocket walls 34 extend downward from the laterally diverging walls 40 connected to the dividers 18. Similarly, the ledges 42, 44 connect the side pocket walls 38 and end pocket walls 36, respectively, to the side walls 14 and end walls 16, respectively. The ledge 42, 44 and laterally diverging walls 40 are substantially coplanar and are substantially coplanar with the lower most edges of the side walls 14 and the end walls 16. The laterally diverging walls 40, together with their respective interior pocket walls 34 defined downwardly open recesses for receiving dividers 18 of a similar tray therein in a nesting position.

Figure 6:
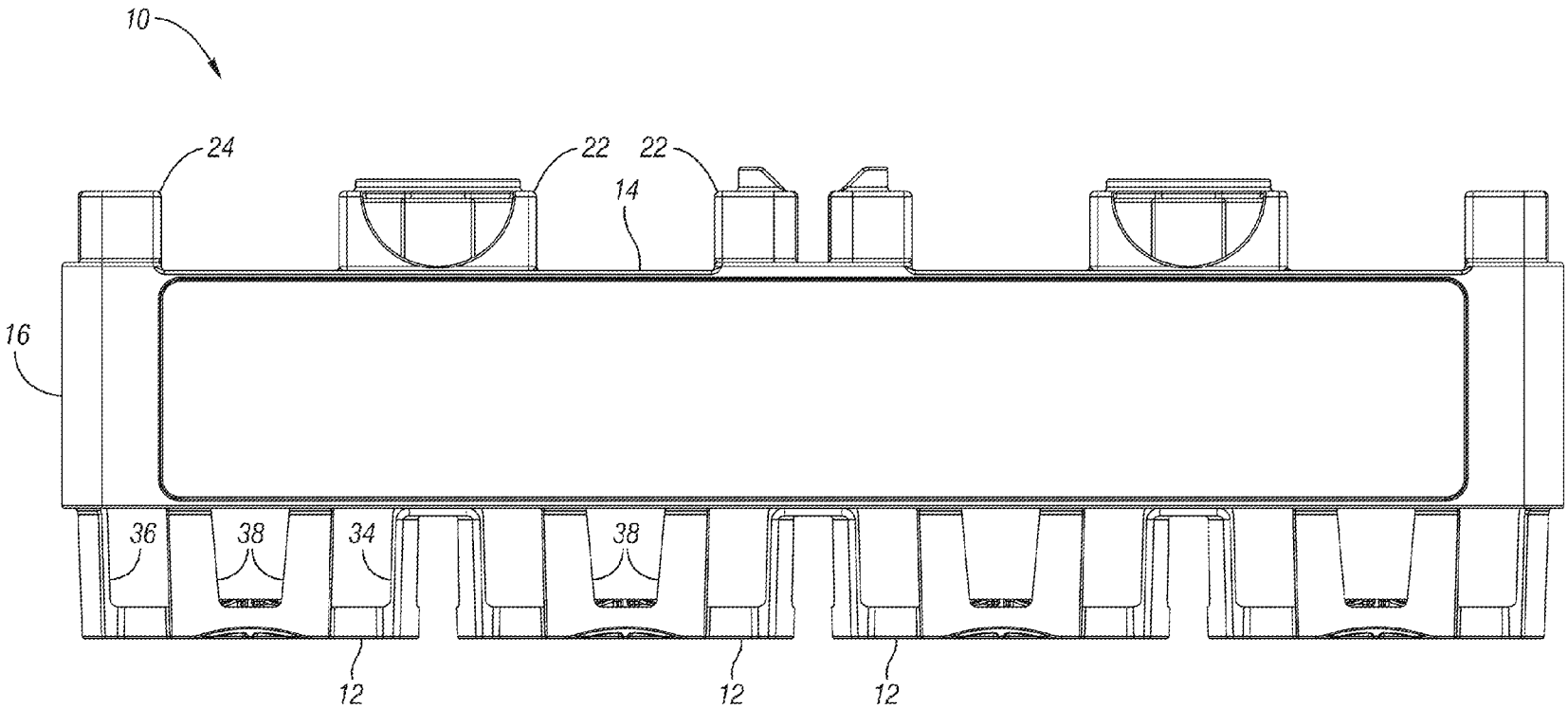
FIG. 6 is a side view of the tray.
Figure 7:
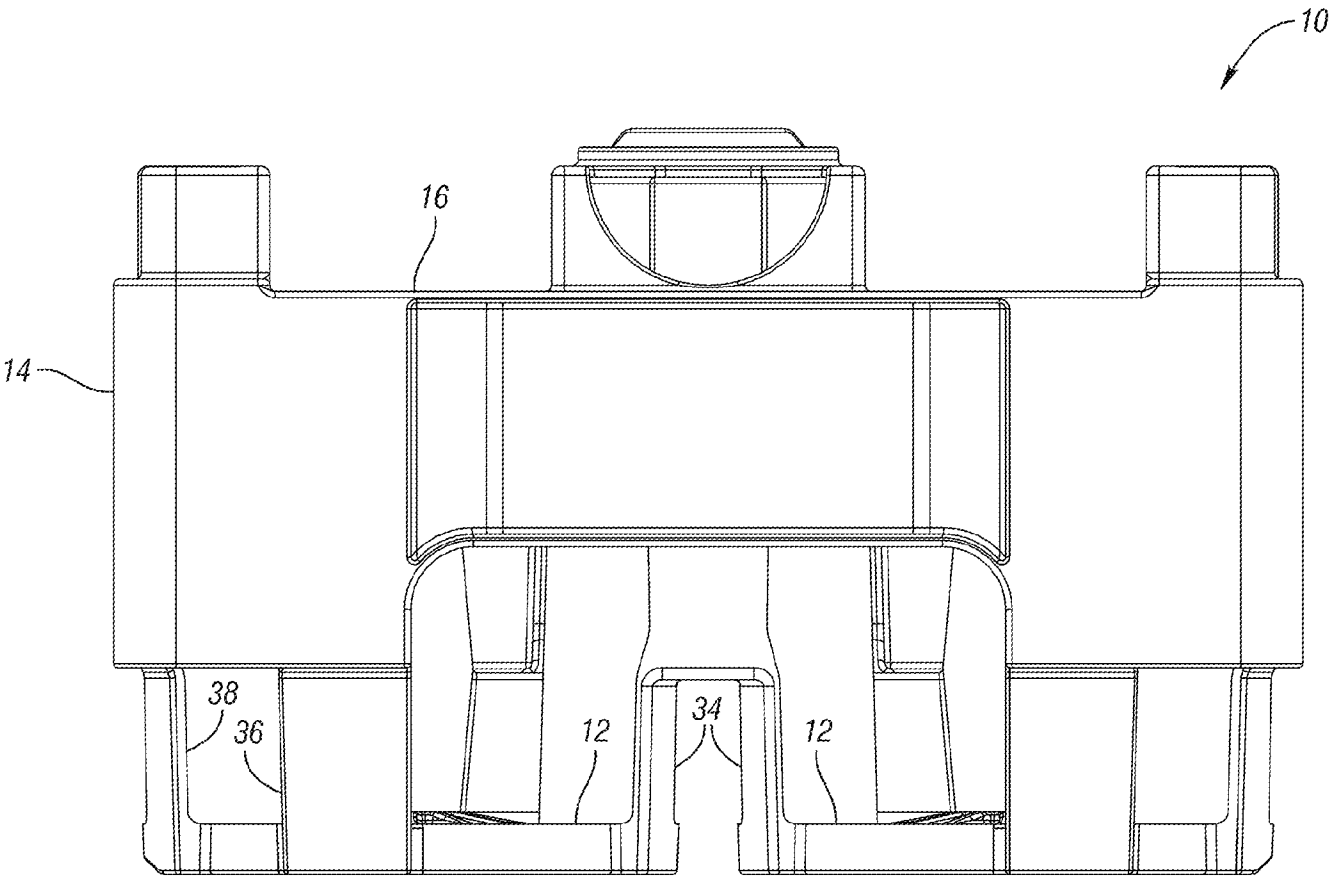
FIG. 7 is an end view of the tray.

FIG. 6 is a side view of the tray 10. As shown, the upper edges of the pocket walls 34, 36, 38 are substantially coplanar with one another and with lower most edges of the side walls 14 and end walls 16. FIG. 7 is an end view of the tray 10. As noted, the upper edges of the pocket walls 34, 36, 38 are substantially coplanar with lower most edges of the side walls 14 and end walls 16. Other arrangements could be utilized; however, this arrangement provides the most efficient nesting with existing trays.

Figure 8:
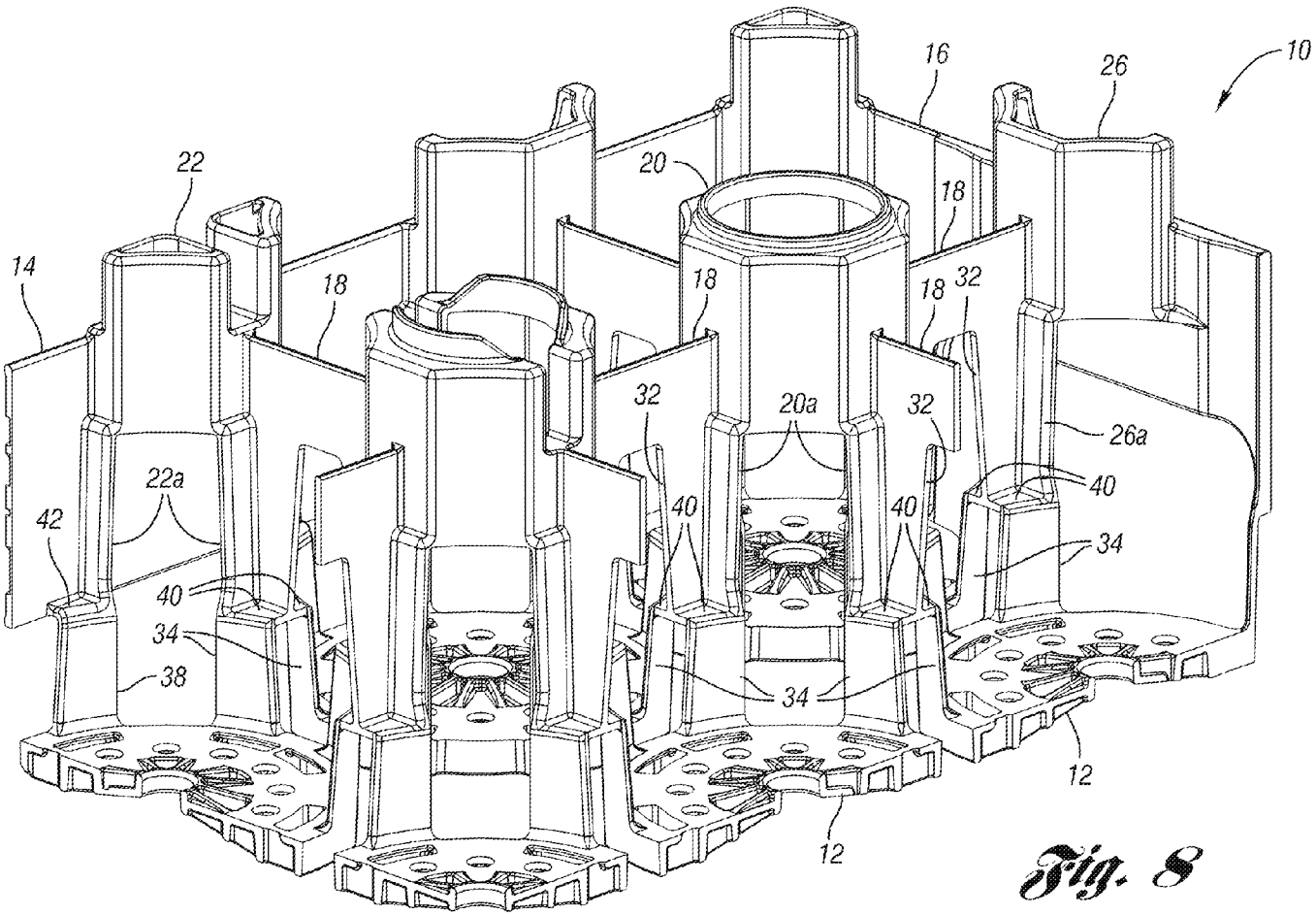
FIG. 8 is a perspective view of the tray of FIG. 1 partially broken away.

FIG. 8 is a perspective view partially broken away of the tray 10. As shown, the dividers 18, particularly the leg portions 32 of the dividers 18 connect to lower portions 20A of the interior columns 20, the lower portions 20A of the columns 20 being substantially transverse to the dividers 18. The lower portions 20A of the columns 20 and the leg portions 32 of the dividers 18 connect to the laterally diverging walls 40, each of which is then connected to the pair of spaced apart interior pocket walls 34, each connecting to a different base wall 12.

Similarly, the side columns 22 have lower portions 22A that intersect the dividers 18 and the side wall 14 substantially transversely and then connect to the ledges 40, 42, which then connect to the interior pocket walls 34 and side pocket walls 38, respectively. Similarly, the end columns 26 each have a lower portion 26A to which the portion 32 of the divider 18 connects substantially transversely. Lower portion 26A of the end column 26 connects to the laterally diverging wall 40 of the divider 18. The interior pocket walls 34 extend downwardly from the laterally diverging wall 40 to the base wall 12. The laterally diverging walls 40 of the dividers 18 together with the associated spaced apart interior pocket walls 34 each define a recess for receiving a divider of a similar tray when nested thereon.

Figure 8A:
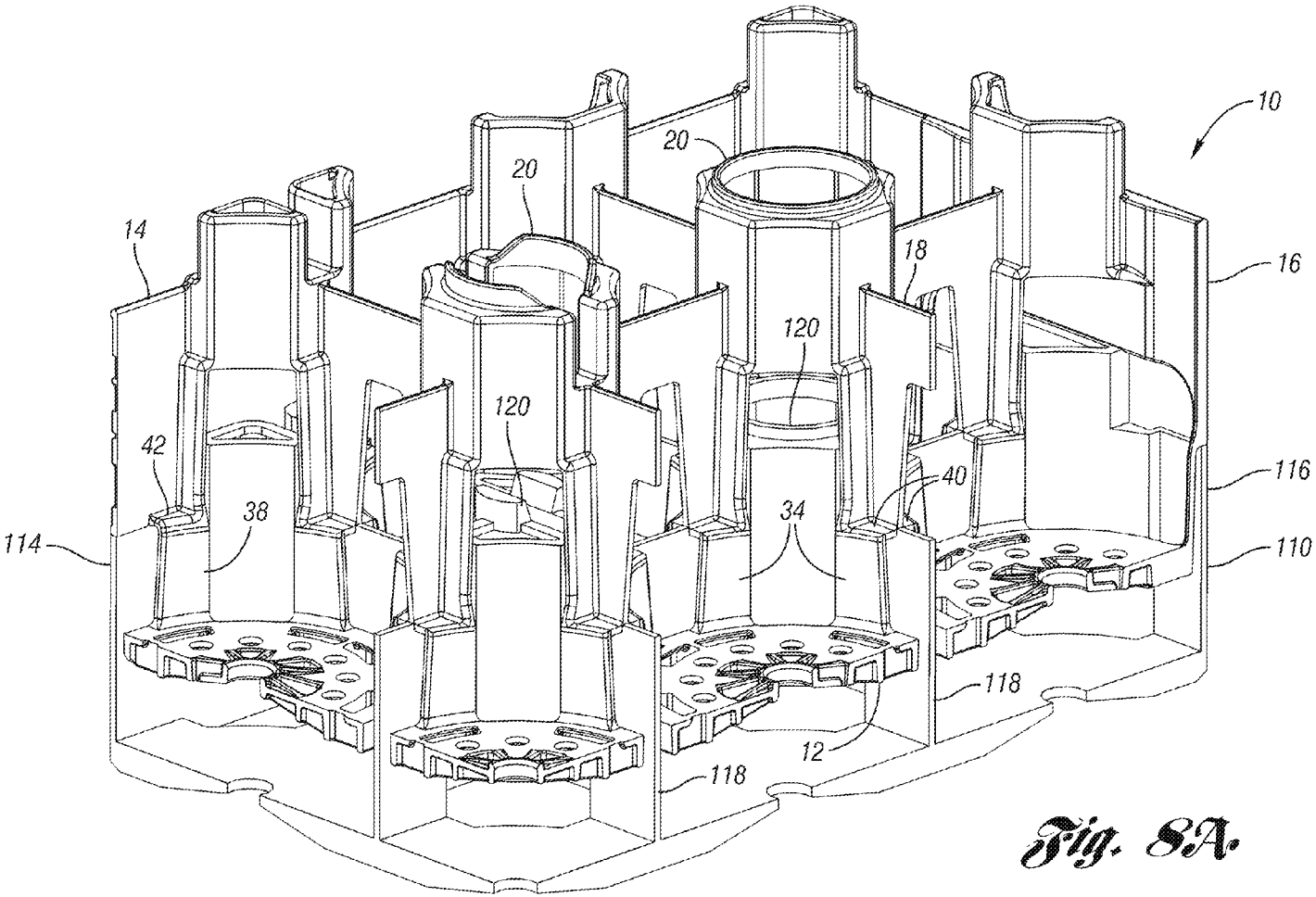
FIG. 8A is a perspective view similar to FIG. 8, with the tray stacked on a prior art tray.

FIG. 8A shows the tray 10 nested on a prior art tray 110 having side walls 114, end walls 116 and dividers 118. As shown, the dividers 118 are received between the interior pocket walls 34 until they abut the dividers 18 and/or the laterally diverging walls 40. Because the pockets walls 34, 36, 38 have a minimum outer diameter, in this example by being curved and single wall thickness, the base walls 12 nest deeply within the dividers 118 of the prior art tray 110, such that the tray 10 is fully nestable within the prior art tray 110, i.e. the side walls 14 rest on the side walls 114 and the end walls 16 rest on the end walls 116. Thus, even with the deeper bottle receiving pockets, the nesting height of the tray 10 is not increased compared to the prior art tray 110.

Figure 9:
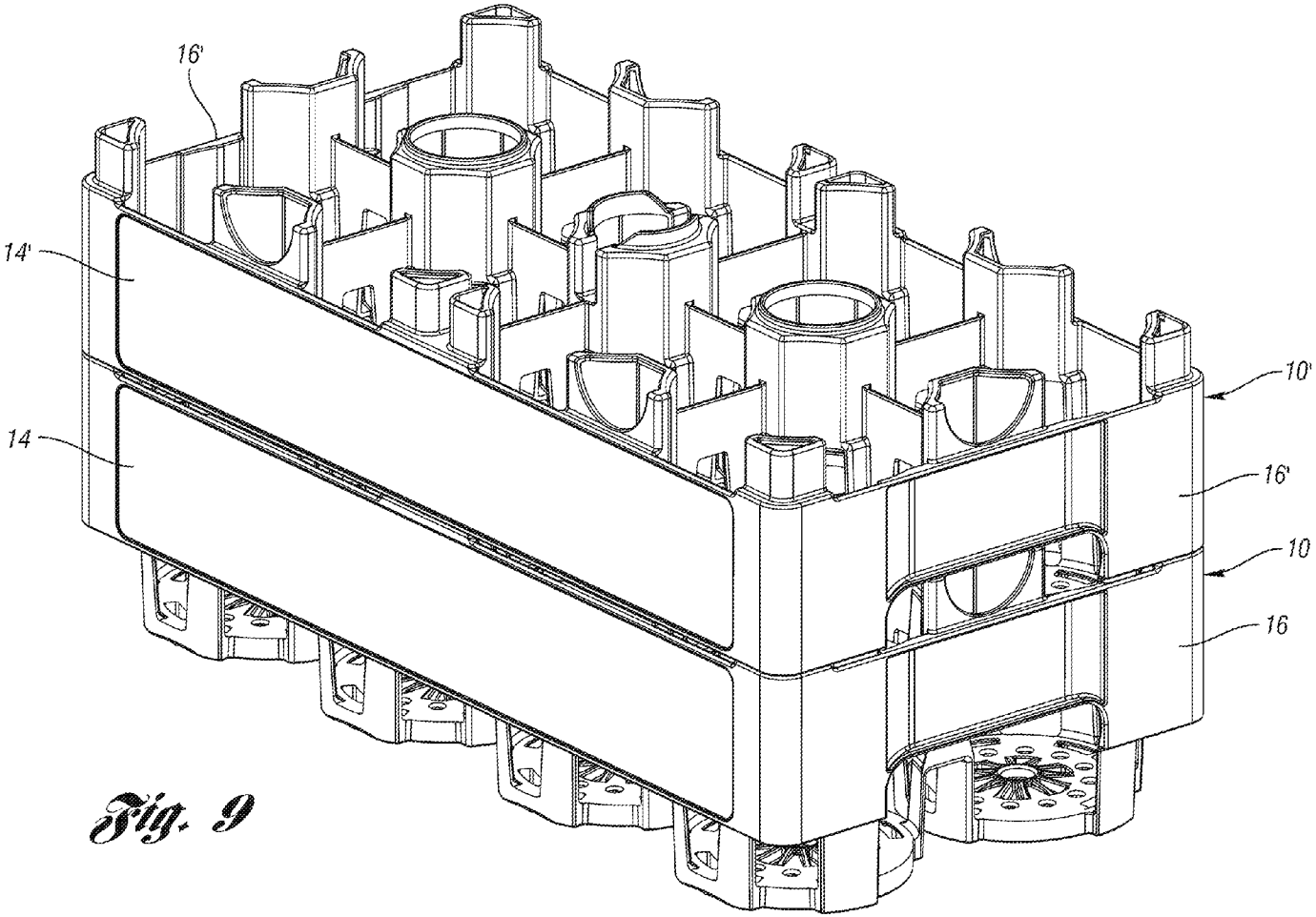
FIG. 9 is a perspective view of the tray of FIG. 1 having a similar tray stacked thereon.

The tray 10 is shown in FIG. 9 having a similar tray 10' nested therein. Again, the trays 10, 10' are fully nested, such that the end walls 16' rest on the end walls 16 and the side walls 14' rest on the side walls 14.

Figure 10:
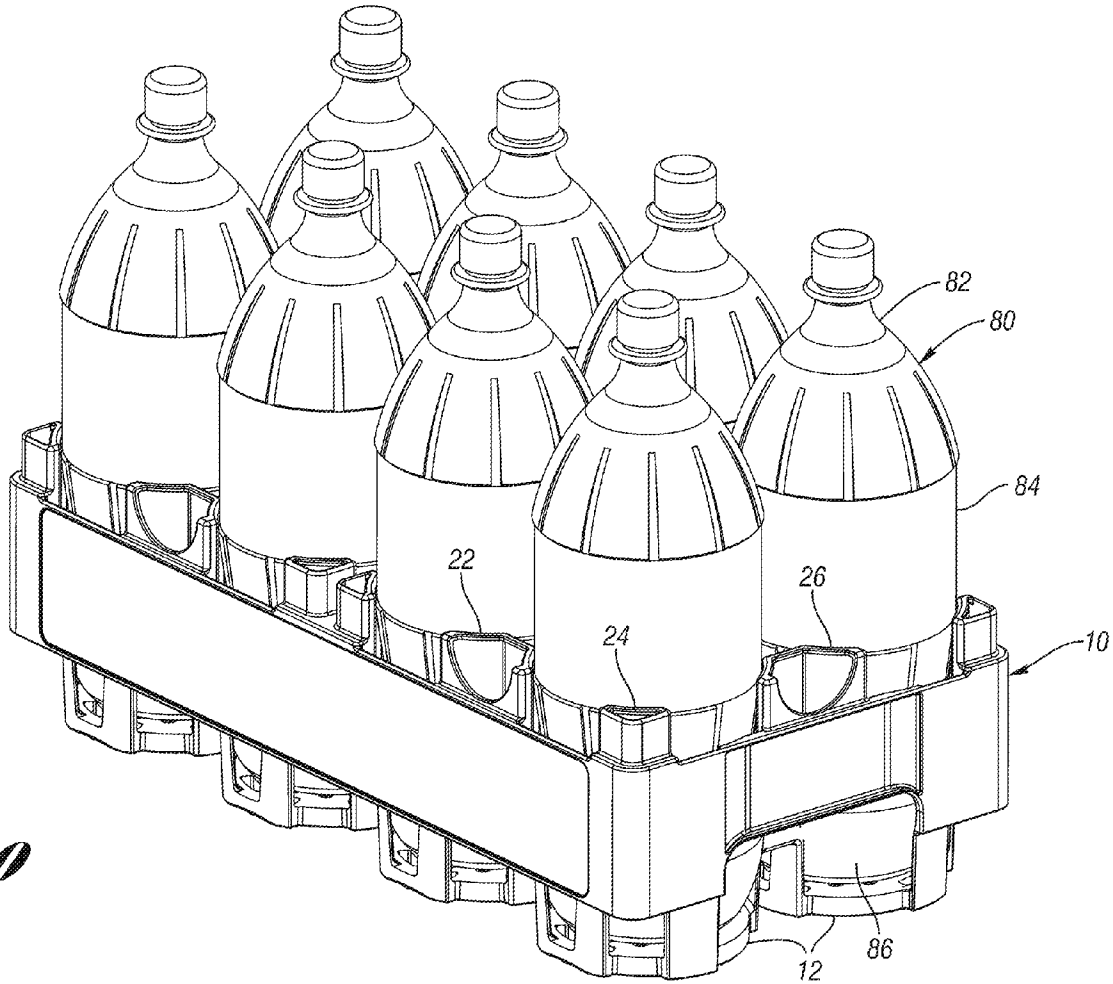
FIG. 10 is a perspective view of the tray of FIG. 1 with a plurality of bottles.

FIG. 10 illustrates the tray with a plurality of bottles 80 stored therein. The bottles shown are two liter bottles, but other bottles could also be used. However, it should be noted that the example tray 10 is designed for large bottles 80, rather than single serving bottles. Each bottle 80 includes a neck portion 82, a body portion 84 and a base portion 86. The base portion 86 tapers inwardly and is somewhat rounded on the sides.

Figure 11:
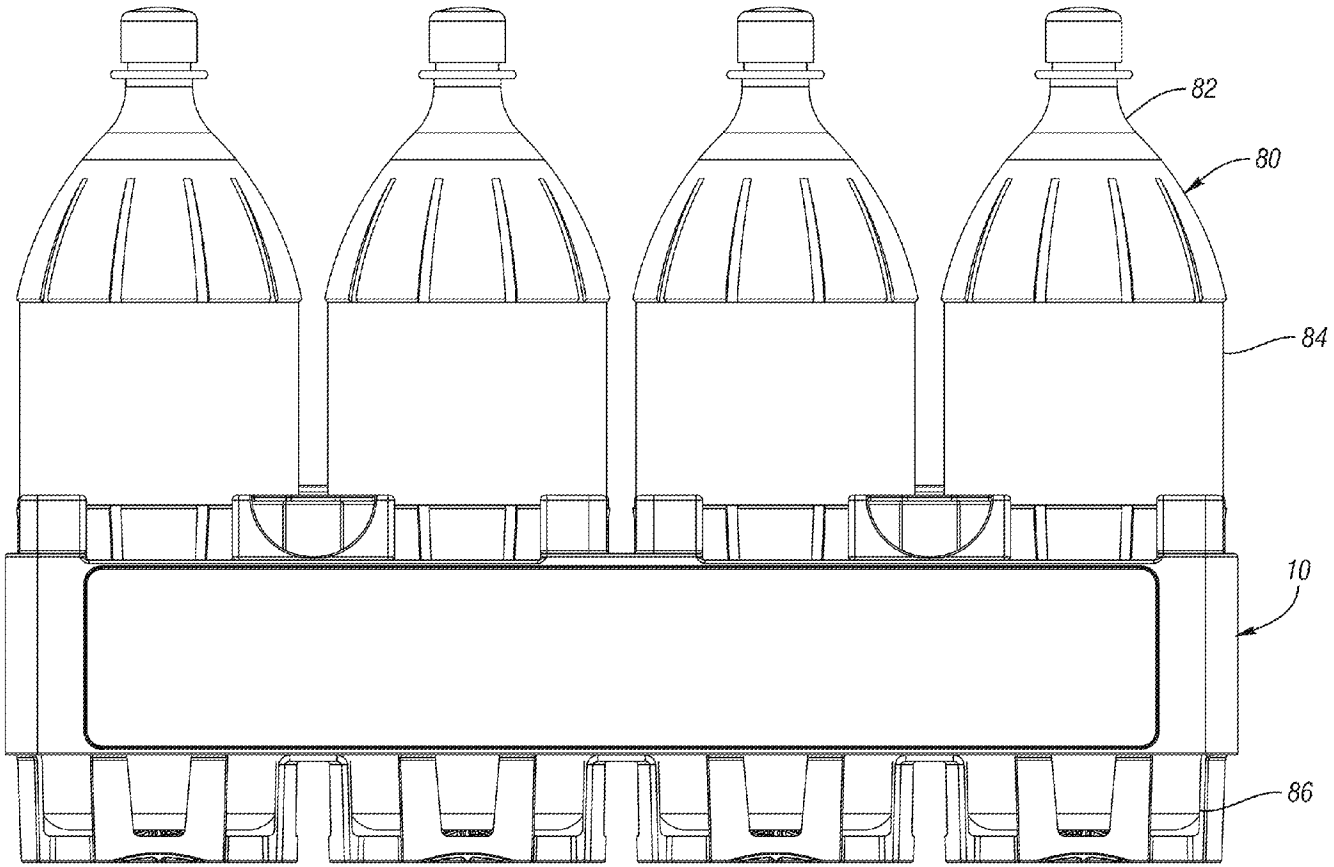
FIG. 11 is a side view of the tray and bottles of FIG. 10.

FIG. 11 is a side view of the tray and bottles of FIG. 10.

Figure 12:
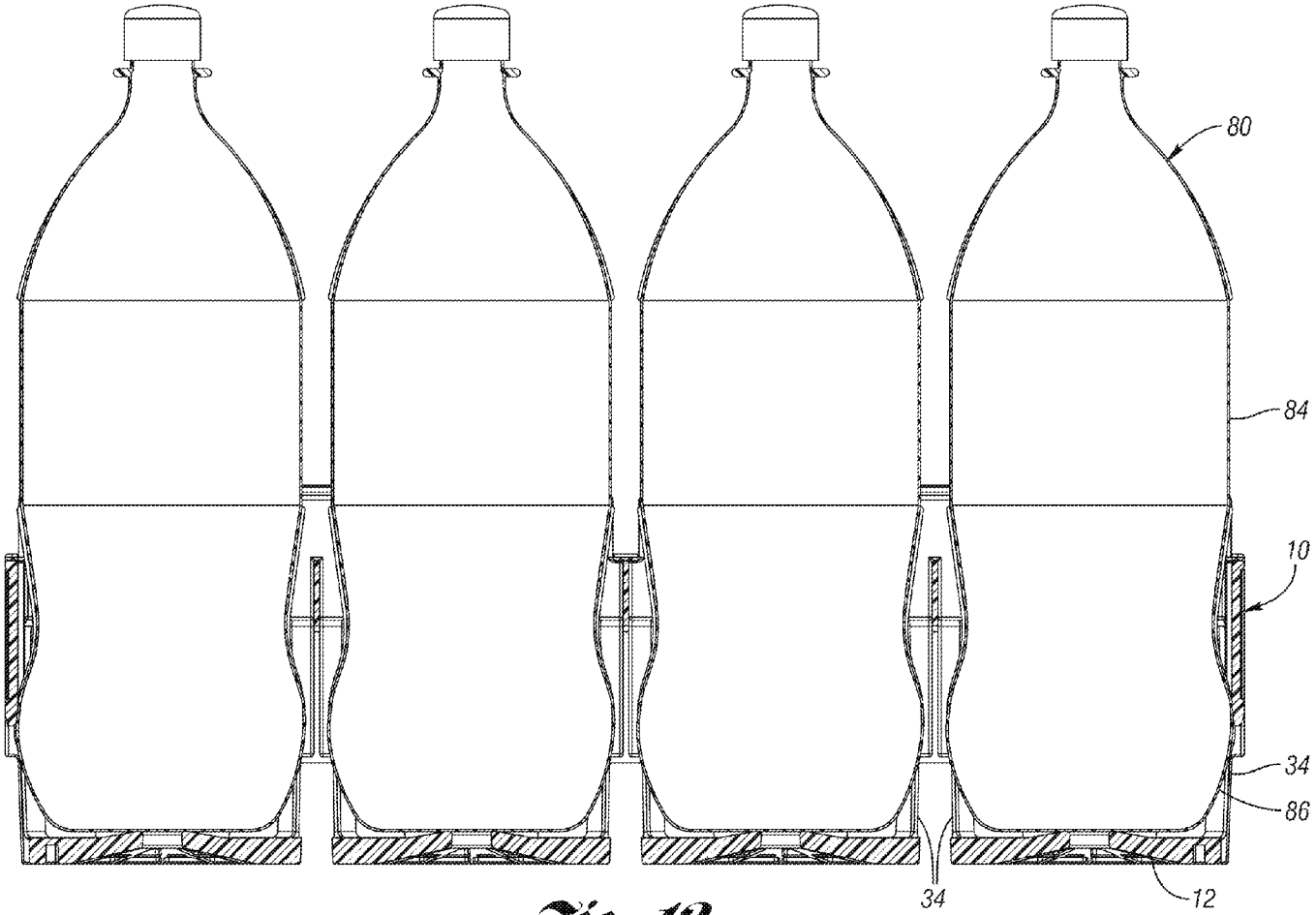
FIG. 12 is a section view through the tray and bottles of FIG. 10.

FIG. 12 is a section view through the tray and bottles of FIG. 10. As shown, the base portion 86 of the bottle 80 (the base portion 86 being defined below a maximum diameter of the bottle 80, i.e. below the body portion 84) is received in the lower pocket portion defined by the pocket walls 34 (and pocket walls 36, 38, which are not shown in FIG. 12).

Figure 12A:
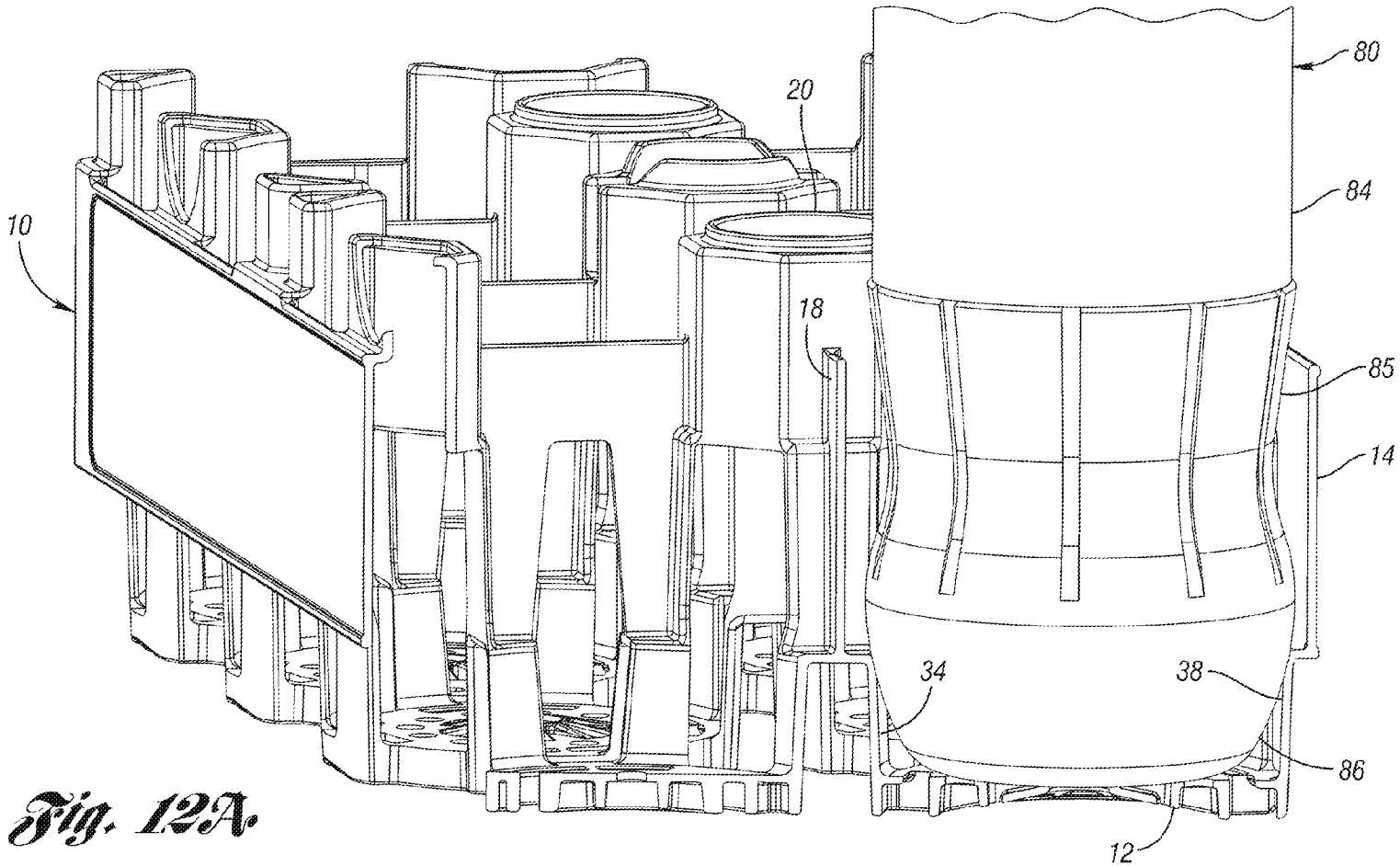
FIG. 12A is an enlarged view of one pocket of the tray and bottles of FIG. 12, with the tray partially broken away.

FIG. 12A is a perspective view of the tray 10 with a single bottle 80 therein, with the tray 10 partially broken away. As shown in FIG. 12A, the diameter of the lower pocket portion defined by the pocket walls 34, 36, 38 is smaller than the maximum diameter of the bottle 80 at the body portion 84. However, the tapered base portion 86 fits within the lower pocket portion defined by the pocket walls 34, 36, 38. In this manner, a deeper pocket can be provided for the bottles 80, while still providing a lower pocket portion that is small enough to be nested within a tray therebelow. This increases the stability of the bottles 80 in the tray 10. This is particularly important for bottles 80 having a contoured body portion 84, as illustrated. The body portion 84 includes a portion 85 of reduced diameter. Without the lower pocket portion the portion 85 of reduced diameter would be adjacent the columns 20, 22, 24, 26, and would not be in contact with them, thus potentially leading to the bottles 80 tipping. By lowering the lower pocket portion, the maximum diameter portion of the body portion 84 contacts the columns 20, 22, 24, 26, thus providing stability to the contoured body 80.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A tray for storing and transporting bottles comprising:

a base including a plurality of spaced-apart base walls for supporting bottles thereon;

a pair of opposed side walls;

a plurality of interior columns between the side walls, the interior columns extending up higher than the side walls;

a plurality of side columns extending up from the side walls;

a plurality of dividers connecting the interior columns to one another and to the side columns, the dividers connecting the base walls to the interior columns; and each divider having a vertical single wall thickness upper portion connected to a lower end including spaced apart pocket walls each connected to a different one of the plurality of spaced-apart base walls, each upper portion including a header portion co-planar with spaced apart leg portions extending downward from the header portion, such that an opening is defined between the leg portions, wherein the dividers are dimensioned and oriented so that the upper portions are received between the spaced apart interior pocket walls of an identical tray nested on the tray.

2. The tray of claim 1 wherein the spaced apart pocket walls are a first pair of spaced apart pocket walls, the divider further including a second pair of spaced apart pocket walls, a first pocket wall of each pair of spaced apart pocket walls connected to a different one of the plurality of base walls.

3. The tray of claim 1 further including a pair of opposed end walls connecting the side walls to one another.

4. The tray of claim 1 wherein the pocket walls are spaced apart curved walls defining pockets for receiving bottles therein.

5. The tray of claim 4 wherein the spaced apart curved walls each include convexly curved facing outer surfaces.

6. The tray of claim 5 wherein the curved walls are connected to the base walls and define a generally cylindrical interior surface.

7. The tray of claim 6 wherein the curved walls are connected to the base walls to define a generally cylindrical exterior surface.

8. The tray of claim 1 wherein the header portion and the spaced apart leg portions are co-planar with one another and single wall thickness.

9. The tray of claim 1 wherein the plurality of interior columns includes three interior columns each having an upper opening formed through an upper surface thereof.

10. A tray for storing and transporting bottles comprising:
a base including a plurality of spaced-apart base walls for supporting bottles thereon;
a pair of opposed side walls;
a plurality of interior columns between the side walls, the interior columns extending up higher than the side walls;
a plurality of side columns extending up from the side walls;
a plurality of dividers connecting the interior columns to one another and to the side columns, the dividers connecting the base walls to the interior columns; and
each divider having a vertical single wall thickness upper portion connected to a lower end including spaced apart pocket walls each connected to a different one of the plurality of spaced-apart base walls, wherein the dividers are dimensioned and oriented so that the upper portions are received between the spaced apart interior pocket walls of an identical tray nested on the tray, wherein the dividers each further include a laterally diverging portion connecting an upper portion of the divider to the spaced apart pocket walls.

11. A tray for storing and transporting bottles comprising:
a base including a plurality of spaced-apart base walls for supporting a bottle thereon, a bottle-receiving pocket defined above each of the base walls;
a pair of opposed side walls, each of the side walls partially defining the plurality of the bottle-receiving pockets;
a plurality of interior columns between the side walls, the interior columns extending up higher than the side walls;
a plurality of dividers connecting the interior columns to one another and to the side walls, the dividers connecting the base walls to the interior columns, each divider having a lower end including spaced apart interior pocket walls each connected to a different one of the plurality of spaced-apart base walls, the interior pocket walls having uppermost edges generally co-planar with lowermost edges of the side walls, wherein the side walls and dividers are formed as a single piece, each divider including an upper portion above the lower end, said upper portion of each divider consisting of a single wall which is the only connection above the lower end of the each divider between an adjacent pair of interior columns or between one of the interior columns and one of the side walls, wherein the uppermost edges of the interior pocket walls are spaced apart.

12. The tray of claim 11 wherein side pocket walls depend from the side walls, the side pocket walls spaced inwardly from the side walls.

13. The tray of claim 12 wherein the side walls are connected to the side pocket walls by side ledges.

14. The tray of claim 13 wherein the dividers are connected to the interior pocket walls by interior ledges.

15. The tray of claim 14 wherein the interior ledges are generally coplanar with the side ledges.

16. The tray of claim 11 wherein the dividers are dimensioned and oriented to be received between the spaced apart interior pocket walls of a similar tray nested thereon.

17. The tray of claim 16 wherein the dividers are dimensioned and oriented to contact lowermost edges of the upper portions of the dividers of the similar tray nested thereon.

18. The tray of claim 11 wherein the dividers each further include a laterally-diverging wall portion connecting an upper portion of the divider to the spaced apart interior pocket walls.

19. A tray for storing and transporting bottles comprising:
a base including a plurality of spaced-apart base walls for supporting a bottle thereon;
a pair of opposed side walls, side pocket walls depending downward from the side walls, the side pocket walls spaced inwardly from the side walls, wherein bottom-most edges of the side walls are in a plane higher than an upper-most surface of the base walls;
a pair of opposed end walls connecting the side walls;
a plurality of interior columns between the side walls, the interior columns extending up higher than the side walls;
a plurality of exterior columns extending up from the side walls; and
a plurality of dividers connecting the interior columns to one another and to the side walls, the dividers connecting the base walls to the interior columns, each divider having a lower end including spaced apart curved interior pocket walls each connected to a different one of the plurality of spaced-apart base walls, each divider including an upper portion above the lower end, said upper portion of each divider consisting of a single wall which is the only connection above the lower end between an adjacent pair of interior columns or between one of the interior columns and one of the side walls, the interior pocket walls having uppermost edges generally co-planar with uppermost edges of the side pocket walls.

20. The tray of claim 19 further including a bottle supported on one of the base walls, the bottle having a neck portion, a base portion and a body portion connecting the neck portion to the base portion, the base portion tapering inwardly toward a bottom of the base portion, at least a portion of a pocket defined by the side pocket walls and the interior pocket walls having a diameter less than a diameter of the body portion of the bottle.

21. A tray comprising:
a base;
a pair of side walls extending upwardly from opposite edges of the base;
a plurality of side columns extending upwardly from the side walls;
a plurality of interior columns between the side walls, the interior columns extending upwardly from the base; and
a divider connecting one of the plurality of interior columns to one of the plurality of side columns, wherein the divider includes an upper portion and a lower portion, the lower portion including two spaced apart pocket walls extending down to the base, the upper portion consisting of only a single wall above the lower portion, wherein the single wall is the only connection between the one of the plurality of interior columns and the one of the plurality of side columns, the single wall including a header and at least two spaced-apart portions co-planar with the header.

22. The tray of claim 21 wherien the base includes a plurality of spaced-apart base walls for supporting bottles thereon.

23. A tray comprising:
a plurality of base walls;
a pair of side walls extending upwardly from the base walls;

a plurality of side columns extending upwardly from the side walls;

a plurality of interior columns between the side walls, the interior columns extending upwardly from the base walls; and a divider connecting one of the plurality of interior columns to either another of the plurality of interior columns or a side column, wherein the divider includes a single-walled upper wall portion and a lower wall portion, the lower wall portion including at least two generally coplanar spaced-apart leg portions;

wherein a horizontal element connects one of the plurality of base walls to the lower wall portion of the divider, the horizontal element extending in a direction generally parallel to the plane of the base walls;

wherein one of the plurality of base walls is connected to another of the plurality of base walls by way of a generally vertical pocket wall, the pocket wall connected to one of the spaced-apart lower portions by way of the horizontal element, the pocket wall extending generally perpendicular to the horizontal element in a downward direction.

24. The tray of claim 23 wherien the plurality of base walls are spaced-apart base walls each for supporting a bottle thereon.

* * * * *